United States Patent [19]

Revelli et al.

[11] Patent Number: 4,630,932

[45] Date of Patent: Dec. 23, 1986

[54] DISPERSING APPARATUS WITH WIRE WHEEL IMPELLER

[76] Inventors: Anthony J. Revelli, 395 Pinebrook Blvd., New Rochelle, N.Y. 10804; Herbert Greenfield, 81-11-155 Ave., Howard Beach, N.Y. 11414

[21] Appl. No.: 827,895

[22] Filed: Feb. 10, 1986

[51] Int. Cl.[4] ..... B01F 7/16

[52] U.S. Cl. ..... 366/279; 366/309; 366/315

[58] Field of Search ..... 366/309, 607, 279, 285, 366/286, 315, 604, 310, 312, 317, 325, 326; 15/198

[56] References Cited

U.S. PATENT DOCUMENTS

| | | | |
|---|---|---|---|
| 1,417,965 | 5/1922 | Belcher | 366/309 |
| 1,774,910 | 9/1930 | Whatmough | 366/309 |
| 2,739,332 | 3/1956 | Flohr | 15/198 |
| 2,844,835 | 7/1958 | Benyak | 15/198 |
| 3,298,618 | 1/1967 | Talpey | 366/315 |
| 3,362,691 | 1/1968 | Shilling | 366/279 |
| 3,583,020 | 6/1971 | Bateman | 15/198 |

*Primary Examiner*—Robert W. Jenkins
*Attorney, Agent, or Firm*—Roger S. Benjamin

[57] ABSTRACT

An apparatus for dispersing pigment in a liquid comprising: a mixing vessel, a stirrer shaft with affixed impeller, a motor for rotating the shaft, and support structure for positioning the rotatable shaft and impeller within the vessel; with the improvement of using as an impeller a wire wheel of radially extending stiff wires, the wheel having corrugated sides formed from the outermost layers of wires. A method of dispersing solids using the apparatus of the invention is also described.

27 Claims, 4 Drawing Figures

DISPERSING APPARATUS WITH WIRE WHEEL IMPELLER

BACKGROUND OF THE INVENTION

Shaft mounted impellers rotated at high speed by electric motors have been used for grinding, dispersing, deagglomerating, and mixing in solid/liquid systems. Typically, such apparatus have been used as part of a process for the preparation of dispersed pigments useful in products such as paints and inks.

Prior art high speed, high torque dispersion impellers have generally been unable to grind or disperse hard pigments to a 6 plus Hegman index even after hours of operation. The products of such prior art dispersion impellers generally requires further treatment with roller mills, colloid mills, or sand mills, etc., to achieve the desired results (see, Introduction to Paint Technology, 4th edition 1976, published by Oil & Colour Chemists Association, Priory House, 967 Harrow Road, Wembley, Middlesex HAO 2SF, page 147 section, "High Speed Disperser").

U.S. Pat. No. 1,774,910 issued to Whatmough illustrates a rotor made of sandwiched wire gauze segments with projecting ends held in place with bolted side plates.

U.S. Pat. No. 3,894,694 issued to Rothman illustrates a mixing device that depends on the cooperative action of a rotor and a stator.

It is desirable to develop an impeller effective for dispersing and grinding that does not require separate structural elements or have its liquid agitating surfaces severely reduced by its mode of construction.

SUMMARY OF THE INVENTION

This invention is an apparatus for dispersing solids in a liquid.

This invention is also an improved method of dispersing pigments in a liquid using the apparatus of this invention.

This invention is also a dispersing impeller of improved efficacy.

DETAILED DESCRIPTION OF THE INVENTION

The field of use of this invention is broadly any application where a solid is to be dispersed into a liquid. The term "dispersing" as used herein refers to grinding, deagglomerating, wetting, or subdividing a solid phase to achieve; increased uniformity, improved stability, reduced tendency to phase separation, and absence of oversize particles.

The product of the invention is typlified by an ink or paint or a concentrated pigmented paste consisting of a vehicle with dispersed pigment useful for formulating an ink or paint.

The solids content of the dispersed solid/liquid mixed product of this invention is typically from about 10 weight percent to about 30 weight percent.

Raw Materials:

This invention is advantageously used for dispersal of pigments. Suitable pigments include inorganic pigments, carbon pigments, metallic pigments, and organic pigments. The term, "pigments", as used herein is inclusive of extenders and other solids. Examples of inorganic pigments are titanium dioxide, zinc oxide, basic lead carbonate, precipitated chalk, oxides of iron, zinc chromes, and cadmium sulphide. Organic pigments are typlified by phthalocyanine blues and greens, quinacridone pigments, and dioxazine pigments.

Bulk pigment powders are received as large agglomerated particles. The function of the dispersing impeller is to subdivide these particles so they may be wetted by the liquid vehicle. The exact extent of dispersion required will vary with the intended final use.

The vehicle may be aqueous or non-aqueous. Typical non-aqueous vehicles are turpentines, kerosene, toluene, xylene, naphthas, mineral spirits, linseed oil, vegetable oils, tung oil, liquid resins, and etc.

The solid and liquid ingredients of the dispersed solid/liquid product may be added separately to the mixing vessel. Alternatively, these ingredients may be added as a premixed suspension having solid particles initially too large for the intended use.

Parts of the Apparatus:

The elements of the apparatus for dispersing substances in a liquid vehicle are as follows:

(1) a vessel for holding the liquid vehicle and dispersable solid.

(2) a rotatable stirrer shaft.

(3) an impeller for dispersing the contents of the vehicle containing vessel, the impeller also capable of being affixed to the rotatable shaft.

(4) means for rotating the impeller equipped shaft, viz., a motor.

(5) support structure means for positioning the motor to rotate the shaft with impeller and position the impeller within the vehicle containing vessel.

The dispersion of solids in a liquid is done in a mixing vessel of conventional design. Shape and construction of the vessel are not critical although cylindrical containers are generally used for this purpose. The mixing vessel is advantageously outfitted with inlet and outlet ports for introduction of raw material and removal of product.

It is contemplated in the practice of this invention that the vessel or its parts not make physical contact with the dispersing impeller.

The apparatus of the invention has a shaft rotating means capable of rotating a stirrer at high speed. Typically, an electric motor is used for this purpose. The motor is equipped with a chuck or other gripping means for holding a stirring shaft.

The stirring shaft that fits into the gripping means rotated by the motor is positioned generally downward into the mixing vessel. Usually the stirrer shaft is positioned substantially vertically, but it may assume an angular placement, if desired.

The impeller disc should be at some position on the stirrer shaft where it is capable of being fully immersed into the solid/liquid mixture to be dispersed. Generally, the impeller is affixed at or near the downward end of the stirrer shaft.

The support structure is any conventional design which supports in a stable configuration and cooperative relationship the motor, stirrer/impeller, and mixing vessel required for operation according to this invention. Suitable support structures are illustrated in the drawings of U.S. Pat. Nos. Des. 244,757 and 3,018,666; the disclosures of which are incorporated herein by reference.

The Novel Dispersing Impeller:

The dispersing impeller of the invention has the general shape of a disc or wheel. The two parallel circular extremities defining the top and bottom of the disc are hereinafter referred to as the "sides". The circular band defining the width at the disc perimeter is hereinafter referred to as the "face".

The impeller is formed from radially extending stiff wires attached to a hub. The hub of the impeller is a circular plate (generally made of steel) with a center hole for shaft mounting and evenly spaced concentric openings near its periphery for attaching wires used in the impeller construction. The individual wires forming the main body of the impeller are defined as "stiff" to denote that when viewed under quiescent conditions they are substantially dimensionally stable and do not droop, move, or otherwise change their radially extended positions.

The stiffness of a wire used in the impeller will generally depend on its diameter and material of construction. Suitable stiffness is readily determined by inspection of the wire. The wire used in impeller construction may be made from a variety of materials including tampico hemp, nylon, brass, iron, oil tempered steel, carbon steel, and stainless steel. Metal wires are preferred for dispersong solids. The use of stainless steel is highly preferred because of its strength and resistance to corrosion.

The "trim length" of the wire used in the impeller is the radial length of wire measured from the impeller periphery face inward to the starting point of the exposed wire forming the corrugated side surface. Typically, the inside edge of the corrugated surface is formed by a side plate or the perimeter of the hub. The trim length measures the exposed radial length of wire on the sides of the impeller that contacts (with its corrugaged surface) the vehicle/solid being dispersed.

The preferred practice of the invention is to construct the impeller from metal wires having a diameter of at least 0.009 inches (0.229 mm.). Most preferred is an impeller formed from wires having a diameter of from 0.009 to 0.04 inches (0.229 mm. to 1.194 mm.). The most preferred embodiment of the invention is to use stainless steel wire because of the strength and resistance to corrosion it lends to the construction of the impeller.

The wires generally radially extending from the hub of the impeller may be straight or crimped. In addition, adjacent wires may be twisted (knot-type) or otherwise combined into groups, with each group containing a plurality of wires. These wire groups radially extend from the hub as spokes on a wheel. A preferred configuration is a cable twist wire wheel impeller having (i) a plurality of uniformly concentrically spaced twisted wire groups, and (ii) each wire group being terminally untwisted for a minor proportion of the groups' terminal radial length to expose separate wires.

An essential feature of the impeller of the invention is that it have an open geometry that allows substantial penetration of the liquid and solids into its interior. Therefore, wire wheel dispersion impellers filled with erodible substances (e.g., rubber or plastic) are excluded from the scope of this invention. In addition, radially extending wires tied together by approximately perpendicular or concentrically positioned crossing wires (e.g., as in a woven structure) inhibit flow and are deleterious to the operation of the impeller.

The sides of the wire wheel disc impeller not only must readily permit penetration of liquid vehicle and solids but must assist dispersing action.

The sides of the dispersing impeller are formed from the outermost (side adjacent) surface layer of wires. The impeller has, therefore, sides having a corrugated surface. A corrugated surface is defined for this invention as a rough undulating surface with generally radially extending ridges and grooves.

This invention is not limited by any theory of operation. However, it is believed that the parallel corrugated sides of the impeller effectively engage the liquid/solids mixture and transmit the force of the rotating impeller to the solid being dispersed.

The disc impeller of the invention is believed to achieve its effective dispersing action from both the individual wire ends which define its circumference and from its corrugated sides formed from the outermost layers of wire.

The use of impellers with smooth planar sides is undesirable and not a part of this invention. Moreover, it is highly desirable that the radial ridges and grooves of the corrugated impeller sides be substantially absent the presence of perpendicular or concentric wires which would inhibit radial flow of the medium being dispersed.

It is required that at least 33.3 percent of the area of the impeller sides be a corrugated surface formed from the outermost surface layer of radially extending stiff wires. Additionally, it is preferred that the trim length of the wire forming the impeller sides be at least 1.125 inches (28.575 mm.) to promote a high degree of effective contact of the impeller with the solid being dispersed.

The entire surface of the impeller sides cannot be corrugated (by radially extending wires or groups of wires) since the center part of the impeller side area is taken up by the hub of the wire wheel, the stirrer shaft mounting washers/retaining nuts, or any side plate used in construction of the wire wheel to limit trim length.

The location of the area of the side required to have a corrugated wire surface is that part defined by the impeller periphery and extending inward toward the hub periphery.

The impeller of the invention may be formed from a plurality (2 or more) of wire wheel impellers adjacently positioned on a stirrer shaft.

The face to diameter ratio of the impeller disc is preferably at least about 1:6. Typically, the impeller is constructed to have a face to diameter ratio of from about 1:6 to about 1:2.

The impeller may be attached to the stirrer shaft by a variety of methods. The stirring shaft can have the form of a rod threaded at one end to permit impeller mounting with nuts and washers. Alternatively, the stirring shaft can have a terminal portion of reduced diameter and an internal screw thread that accepts a bolt. The hole in the impeller hub is placed over the reduced shaft portion and is stopped by the full diameter of the shaft. The threaded bolt holds the bottom of the impeller onto the shaft. Still another arrangement of holding the impeller onto the impeller shaft is by using a metal shaft with a key (projections) to fit into a complementary keyway in the hub of the impeller.

The impeller of the invention performs adequately when it has a certain minimum size. The impeller should preferably be at least 3 inches (101.6 mm.) and more preferably at least 6 inches (152.4 mm.) in diameter for effective dispersion of pigments in paint or ink formulations.

This Method of the Invention:

The method of the invention is practiced by dispersing solids in a liquid using the apparatus of the invention employing the novel impeller of the invention.

Broadly, the liquid vehicle and solid ingredient to be dispersed are placed in a mixing vessel. A stirrer shaft with the novel dispersing impeller (previously described) affixed at a liquid contacting position is contacted with the mixture in the vessel and rotated until the desired degree of dispersion takes place. The stirrer shaft and impeller may be placed in a central or eccentric position in the mixing vessel.

The impeller is rotated at peripheral velocities in the range typically of from 500 to 12,000 feet per minute (2.54 to 60.96 meters per second). The actual rotational speed of the impeller (its angular velocity) will depend on the geometry size of impeller.

Dispersion of solids with a high speed rotating impeller may be carried out under a wide variety of conditions. However, a recommended relative geometry of parts is as follows:

TABLE

| | |
|---|---|
| Impeller Diameter | 1.0 D |
| Tank Diameter | 2.8 D |
| Depth of solid/liquid charge | 2.0 D |
| Impeller Height from Bottom | 0.6 D |

(Source: This Table adapted from the booklet, Easy-Dispersing Pigments for Paints, August 1982, page 2, Dominion Colour Company, a division of Reed Inc., 77 Brown's Line, Toronto, Ontario, M8W 4X9.)

The impeller speed is preferably adjusted so that the vortex formed by the impeller gives a smooth rolling action and the top of the vortex touches the top side of the impeller.

The fineness of grind or degree of dispersion of a pigment is an important measure of its utility. For many applications a Hegman gauge index of at least 6 must be achieved before a pigment is suitable for inclusion in high grade formulations. A 6 plus index rating is particularly difficult to achieve with a hard pigment such as phthalocyanine blue.

A suitable method of judging the degree of dispersion achieved by the method of the invention is with a "Hegman" gauge. This gauge is a steel block having grooves which taper from two thousanths of an inch to zero inches. A sample of pigmented vehicle being tested is placed in the deep end of a groove and drawn down the groove to the shallow end with a straight edge. The mark at which pigment particles are clearly seen is taken as the measure of dispersion. The groove is graduated from 0 to 10 with 0 being the deepest and 10 being the most shallow end of the groove. In practice, a Hegman index of at least 6 (and preferably 7 or more) is necessary for a commercially useful degree of dispersion of a pigment.

The completion of the solids dispersion with the impeller method and apparatus of the invention may be determined by withdrawing periodic samples from the mixing vessel and testing for oversize particles. This testing may be done with a Hegman gauge, if desired. Typical dispersion times of from about ½ to about 12 hours are required to prepare product for use in commercial ink and paint formulations.

EXAMPLE

Figure 1:
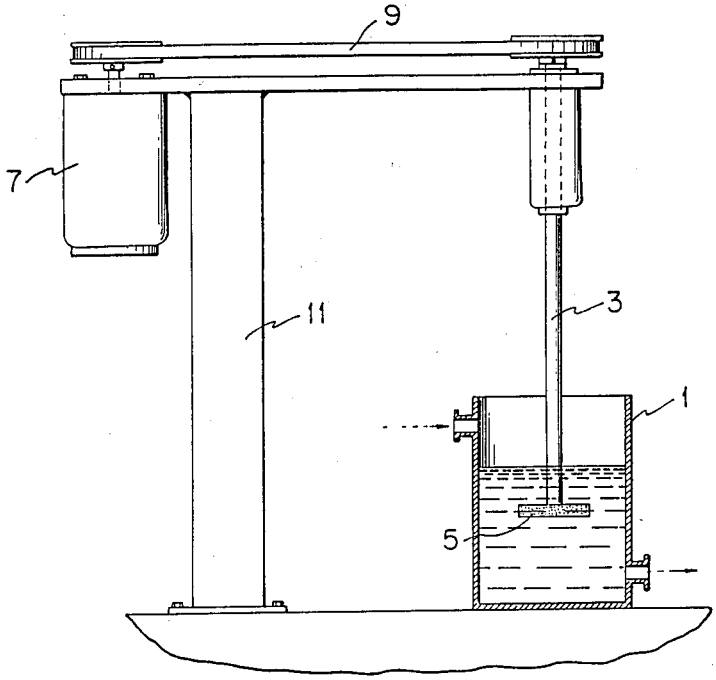
FIG. 1 illustrates the apparatus of the invention. A mixing vessel (1) equipped with inlet and outlet means holds a charge of liquid vehicle and pigment to be dispersed. A stirrer shaft (3) positions the wire wheel disc impeller of this invention (5) within the mixing vessel. The stirrer shaft is rotated by motor (7) through a belt and pulley drive mechanism (9). The vessel, motor, and shaft with impeller are held in cooperative positions with respect to the mixing vessel by the support structure (11).
Figure 2:
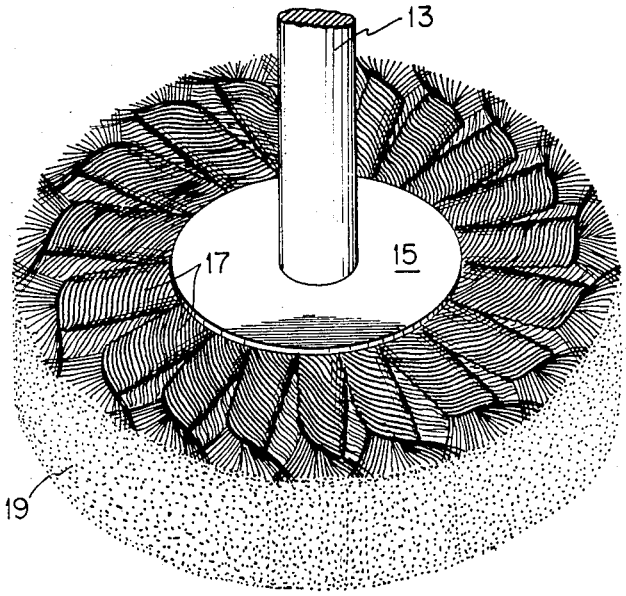
FIG. 2 illustrates the shaft mounted wire wheel disc impeller of the invention. A metal shaft (13) is fastened into the center mounting hole of the wire brush impeller hub. Side plate (15)—top only shown—covers the wheel hub. The impeller has corrugated planar surfaces—top only shown—formed by radially projecting twisted wire bundles typlified by (17). A circumferential face of wire ends (19) is formed by the wires comprising the disc.
Figure 3:
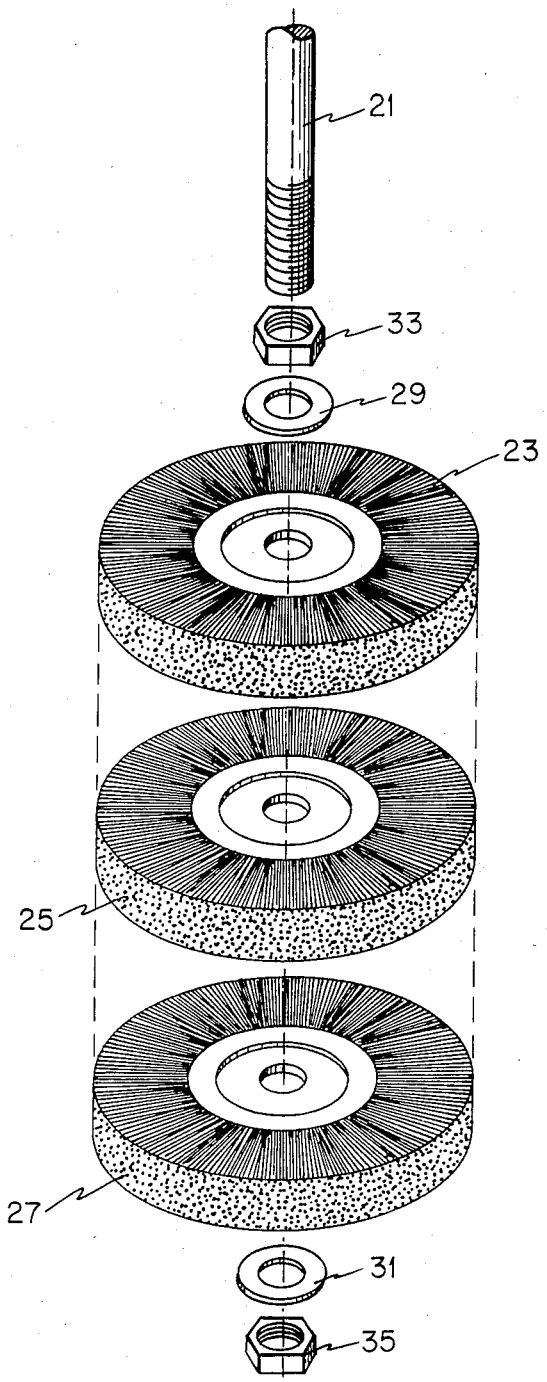
FIG. 3 illustrates an exploded view of the dispersing impeller on a stirrer shaft. Threaded shaft (21) has fitted on it wire wheel dispersing impeller parts (23), (25), and (27). The impeller parts are adjacently held on the shaft by washers (29) and (31) and nuts (33) and (35).
Figure 4:
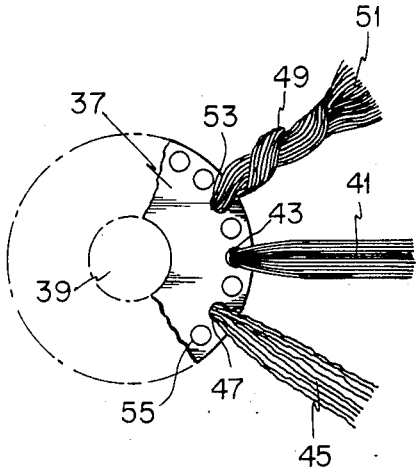
FIG. 4 is a broken top view of an impeller of the invention showing the elements of its construction. The hub (37) has a center shaft mounting hole (39), uniformly distributed concentric peripheral openings—eight only shown—and various forms of radially extending wires. Straight wires (41) extend from opening (43). Crimped wires (45) extend from opening (47). A twisted wire group (49) with untwisted ends (51) extends from opening (53). Additional wires would be added to unfilled openings—exemplified by (55)—in the hub to form the impeller of the invention.

A test batch of 50 gallons (189.3 liters) of phthalocyanine Blue Universal Colorant was prepared on a ten horsepower (7.46 kilowatt) Hochmeyer High Speed Disperser having its vertically positioned stirring shaft fitted with a wire brush disc impeller. The impeller was 8 inches (203.2 mm.) in diameter and 1.75 inches (44.45 mm.) thick. The impeller was constructed of wire twisted together in 34 groups with each group uniformly concentrically distributed near the perimeter of the impeller hub. Each twisted wire group had a trim length of 1.75 inches (44.45 mm.) and contained approximately 60 wires. The last 0.75 inches (19.05 mm.) of radial length of each wire group was untwisted to display individual wires. The impeller sides were fitted with centered retaining plates 4.5 inches (114.3 mm.) in diameter. The sides of the impeller had a corrugated surface that constituted 68% of the area of its sides.

The following batch ingredients were charged to a 55 gallon (208.2 liter) mixing vessel:

20 lbs. (9.07 kg.) pigment, Phthalocyanine Blue;
200 lbs. (90.7 kg.) Kaolin Clay, extender
245 lbs. (111.1 kg.) of Vehicle, Modified Vegetable Oil with surfactant.

The high speed disperser was run for one hour at a speed of 1500 revolutions per minute, peripheral velocity of 3150 feet per minute (16.0 meters per second). At the end of one hour a sample of the colorant was drawn down on a Hegman gauge and a Hegman Index of 6 plus was achieved.

The forms of the invention herein shown and described are to be regarded as examples. It will be apparent to those skilled in the art that many modifications may be made without departure from this invention and the scope of the appended claims.

We claim:

1. An improved apparatus for dispersing substances in a liquid having:

a vessel for holding liquid dispersing medium, a rotatable stirrer shaft,
an impeller affixed to said shaft,
a motor capable of rotating said shaft,
a support structure for positioning said motor to rotate said shaft with impeller, and position said impeller within said vessel, wherein the improvement comprises;

a dispersing impeller in the form of a disc of radially extending stiff wires, the parallel corrugated sides of said impeller formed from the outermost layer of the trim length of said wires, and the face of said impeller formed from the ends of said wires.

2. The apparatus of claim 1 wherein the face to diameter ratio of the impeller is at least 1:6.

3. The apparatus of claim 1 wherein the face to diameter ratio of the impeller is from 1:6 to 1:2.

4. The apparatus of claim 1 wherein at least 33.3 percent of the area of the impeller sides comprise a corrugated surface formed from the outermost layer of radially extending wires.

5. The apparatus of claim 1 wherein the trim length of wires forming the sides of the impeller is at least 1.125 inches.

6. The apparatus of claim 1 wherein the dispersing impeller is at least 3 inches in diameter.

7. The apparatus of claim 1 wherein the dispersing impeller is at least 6 inches in diameter.

8. The apparatus of claim 1 wherein the impeller wires are metal and have a diameter of at least 0.009 inches.

9. The apparatus of claim 8 wherein the impeller wires have a diameter from 0.009 to 0.04 inches.

10. The apparatus of claim 1 wherein the impeller wires are stainless steel.

11. The apparatus of claim 1 wherein the impeller wires are substantially straight.

12. The apparatus of claim 1 wherein the impeller wires are crimped.

13. The apparatus of claim 1 wherein the impeller wires are twisted into radially extending groups with each of said groups containing a plurality of wires.

14. The apparatus of claim 1 wherein the impeller is formed from a plurality of discs adjacently positioned on said rotatable shaft.

15. An improved method of dispersing solids in a liquid medium by placing said solids and liquid medium in a vessel and rotating within said vessel a stirrer shaft having affixed thereto in liquid medium contacting position an impeller, wherein the improvement comprises;

affixing to said shaft as said impeller a dispersing impeller in the form of a disc of radially extending stiff wires, the parallel corrugated sides of said impeller formed from the outermost layer of the trim length of said wires, and the face of said impeller formed from the ends of said wires, then rotating said shaft with impeller within said vessel for a time and at a peripheral velocity sufficient to disperse said solids.

16. The method of claim 15 wherein the impeller is rotated at a peripheral velocity of from about 500 to about 12,000 feet per minute.

17. The method of claim 15 wherein the pigment is dispersed for a time sufficient to achieve a Hegman gauge rating of over 6.

18. The method of claim 15 used for dispersing pigments vehicles for ink and paint formulations.

19. The method of claim 15 wherein the impeller is rotated with an electric motor.

20. The method of claim 15 wherein the face to diameter ratio of the disc is at least 1:6.

21. The method of claim 15 wherein the trim length of the wires forming the sides of the impeller is at least 1.125 inches.

22. The method of claim 15 wherein at least 33.3 percent of the area of the impeller sides comprise a corrugated surface formed from the outermost layer of radially extending wires.

23. The method of claim 15 wherein the dispersing impeller is at least 3 inches in diameter.

24. The method of claim 15 wherein the impeller wires are metal and have a diameter of at least 0.009 inches.

25. The method of claim 15 wherein the impeller wires are stainless steel.

26. The method of claim 15 wherein the impeller wires are twisted into radially extending groups with each of said groups containing a plurality of wires.

27. The method of claim 15 wherein the impeller is formed from a plurality of discs adjacently positioned on said rotatable shaft.

* * * * *